US010989189B2

(12) United States Patent
Pushkarev et al.

(10) Patent No.: US 10,989,189 B2
(45) Date of Patent: Apr. 27, 2021

(54) PROGRESSIVE CAVITY MOTOR DAMPENING SYSTEM

(71) Applicant: Schlumberger Technology Corporation, Sugar Land, TX (US)

(72) Inventors: Maxim Pushkarev, Katy, TX (US); Shun'etsu Onodera, Katy, TX (US); Samba Ba, Katy, TX (US); Pierre Lauric Dubesset, Dubai (AE); Peter T. Cariveau, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/538,239

(22) PCT Filed: Dec. 18, 2015

(86) PCT No.: PCT/US2015/066557
§ 371 (c)(1),
(2) Date: Jun. 21, 2017

(87) PCT Pub. No.: WO2106/109242
PCT Pub. Date: Jul. 7, 2016

(65) Prior Publication Data

US 2018/0003175 A1 Jan. 4, 2018

Related U.S. Application Data

(60) Provisional application No. 62/098,983, filed on Dec. 31, 2014.

(51) Int. Cl.

| | |
|---|---|
| ***F04C 2/107*** | (2006.01) |
| ***F04C 13/00*** | (2006.01) |
| ***F01C 1/10*** | (2006.01) |

(52) U.S. Cl.
CPC ..... *F04C 2/1075* (2013.01); *F01C 1/101* (2013.01); *F04C 13/008* (2013.01); *F04C 2240/80* (2013.01); *F04C 2270/16* (2013.01)

(58) Field of Classification Search
CPC .... F01C 1/101; F01C 5/00; F01C 5/04; F04C 13/008; F04C 2240/80; F04C 2270/16;
(Continued)

(56) References Cited

U.S. PATENT DOCUMENTS

| | | | |
|---|---|---|---|
| RE21,374 | E | 2/1940 | Moineau |
| 3,975,120 | A | 8/1976 | Tschirky |

(Continued)

FOREIGN PATENT DOCUMENTS

| | | | |
|---|---|---|---|
| CN | 85108579 | A | 5/1987 |
| CN | 2606814 | Y | 3/2004 |

(Continued)

OTHER PUBLICATIONS

English Machine Translation of JP2005299495A, translated on Jan. 17, 2019, Espacenet.*

(Continued)

*Primary Examiner* — Mary Davis
*Assistant Examiner* — Paul W Thiede

(57) ABSTRACT

A rotor and/or stator dampening system includes a stator and/or rotor with a liner selected of one or more materials to achieve a desired dampening effect. In one implementation, a progressive cavity motor or pump includes a stator with an internal axial bore therethrough. The stator has a liner along an axial length thereof with an inwardly facing surface defining the internal axial bore therethrough. The liner has a plurality of axial sections with at least two of the plurality of axial sections being constructed of different materials. A compression resistant mechanism, such as a spring or spring-like device, is disposed within at least one of the axial (Continued)

sections of the liner. The progressive cavity motor or pump also includes a rotor that is disposed and is rotatable within the internal axial bore of the stator to form a moving chamber between the rotor and the stator.

20 Claims, 1 Drawing Sheet

(58) Field of Classification Search
CPC .... F04C 2/1075; F04C 2/1071; F04C 2/1073; F04C 18/1075; F04C 2240/10; F04C 2240/20
USPC ..... 418/48, 201.1, 153, 182
See application file for complete search history.

(56) References Cited

U.S. PATENT DOCUMENTS

| | | | | |
|---|---|---|---|---|
| 5,171,138 | A | 12/1992 | Forrest | |
| 5,221,197 | A | 6/1993 | Kochnev et al. | |
| 2004/0149431 | A1* | 8/2004 | Wylie | C09K 8/12 166/242.1 |
| 2009/0016893 | A1* | 1/2009 | Lee | F04C 2/1075 416/241 R |
| 2009/0169364 | A1 | 7/2009 | Downton | |
| 2009/0223676 | A1 | 9/2009 | Eddison et al. | |
| 2012/0132470 | A1 | 5/2012 | Jarvis et al. | |
| 2013/0048384 | A1* | 2/2013 | Jarvis | E21B 4/02 175/61 |
| 2013/0115058 | A1 | 5/2013 | Hayashimoto et al. | |
| 2013/0133950 | A1 | 5/2013 | Hohl et al. | |
| 2013/0149182 | A1* | 6/2013 | Sreshta | F01C 1/22 418/178 |
| 2014/0170011 | A1* | 6/2014 | Clouzeau | E21B 4/02 418/201.1 |
| 2019/0145374 | A1* | 5/2019 | Parhar | E21B 43/126 418/48 |

FOREIGN PATENT DOCUMENTS

| | | | |
|---|---|---|---|
| CN | 2703148 | Y | 6/2005 |
| CN | 205744421 | U | 11/2016 |
| JP | 2005299495 | A | 10/2005 |
| WO | 2012122321 | A2 | 9/2012 |

OTHER PUBLICATIONS

English Machine Translation of SN85108579A, translated on Jun. 3, 2020 (Year: 1987).*
International Search Report and Written Opinion issued in International application PCT/US2015/066557.
International Preliminary Report on Patentability issued in International patent application PCT/US2015/066557 dated Jul. 4, 2017, 7 pages.
Search Report R. 62 and Examination Report issued in European patent application 15875987.8 dated Apr. 25, 2018, 7 pages.
First Office Action and Search Report issued in Chinese Patent Application 201580075051.3 dated Aug. 15, 2018, 10 pages.
Second Office Action and Search Report issued in Chinese Patent Application 201580075051.3 dated Apr. 2, 2019, 12 pages.
Third Office Action ssued in Chinese Patent Application 201580075051.3 dated Oct. 8, 2019, 7 pages.
Fourth Office Action issued in Chinese Patent Application 201580075051.3 dated Jan. 17, 2020, 8 pages.

* cited by examiner

PROGRESSIVE CAVITY MOTOR DAMPENING SYSTEM

CROSS-REFERENCE TO RELATED APPLICATIONS

The present application claims the benefit of, and priority to, U.S. Provisional Patent Application No. 62/098,983, filed Dec. 31, 2014, which is hereby incorporated by reference in its entirety.

BACKGROUND

One or more implementations described herein generally relate to Moineau-type pumps and motors inclusive of positive displacement or progressive cavity motors and pumps. Such implementations that may be used when drilling the wellbore of a subterranean well. More particularly, such implementations may incorporate a liner into the stator and/or rotor with the liner selected of one or more materials to achieve a desired dampening effect.

Wellbores are frequently drilled into the Earth's formation to recover deposits of hydrocarbons and other desirable materials trapped beneath the Earth's surface. A well may be drilled using a drill bit coupled to the lower end portion of what is known in the art as a drill string. The drill string has a plurality of joints of drill pipe that are coupled together end-to-end using threaded connections. The drill string is rotated by a rotary table or top drive at the surface, which may also rotate the coupled drill bit downhole. Drilling fluid or mud is pumped down through the bore of the drill string and exits through ports at or near the drill bit. The drilling fluid serves to both lubricate and cool the drill bit during drilling operations. The drilling fluid also returns cuttings to the surface via the annulus between the drill string and the side wall of the wellbore. At the surface, the drilling fluid is filtered to remove the cuttings.

A bottom hole assembly (BHA) is often disposed in drilling string toward the lower end portion thereof. The BHA is a collection of drilling tools and measurement devices and may include the drill bit, any directional or formation measurement tools, deviated drilling mechanisms, mud motors (e.g., Moineau pumps/motors) and weight collars. A measurement while drilling (MWD) or logging while drilling (LWD) collar is often positioned just above the drill bit to take measurements relating to the properties of the formation as the wellbore is being drilled. Measurements recorded from MWD and LWD systems may be transmitted to the surface in real-time using a variety of methods known to those skilled in the art. Once received, these measurements assist operators at the surface in making decisions relating to the drilling operation.

Directional drilling is the intentional deviation of the wellbore from the path that it would naturally take. In other words, directional drilling is the steering of the drill string so that the drill string travels in the desired direction. Directional drilling can be advantageous in offshore drilling because directional drilling permits several wellbores to be drilled from a single offshore drilling platform. Directional drilling also enables horizontal drilling through the formation, which permits a longer length of the wellbore to traverse the reservoir and may permit increased hydrocarbon production. Directional drilling may also be beneficial in drilling vertical wellbores. Often, the drill bit will veer off of an intended drilling trajectory due to the sometimes unpredictable nature of the underground formation and/or the forces the drill bit experiences. When such deviation occurs, a directional drilling system may be employed to return the drill bit to its intended drilling trajectory.

A common directional drilling system and its method of use employ a BHA that includes a bent housing and a Moineau motor/pump, which is also known as a positive displacement motor (PDM) or mud motor. The bent housing includes an upper section and lower section formed on the same section of drill pipe, but the respective sections are separated by a bend in the pipe. The bent housing with the drill bit coupled thereto is pointed in the desired drilling direction. The mud motor is employed to rotate the bent housing and thereby rotate the drill bit to drill in the desired direction.

A mud motor converts some of the energy from the flow of drilling fluid or mud downward through the bore of the drill string into a rotational motion that drives the drill bit. Thus, by maintaining the bent housing at the same azimuth relative to the borehole, the drill bit will drill in a desired direction. When straight drilling is desired, the entire drill string, including the bent housing, is rotated from the surface by the rotary table or top drive, as previously described. The drill bit may angulate with the bent housing and therefore may drill a slight overbore, but straight, wellbore.

PDM power sections include a rotor and a stator. The stator may be a metal tube, e.g., steel, with a rubber or elastomer molded and disposed to an inner surface thereof to form a multi-lobed, helixed interior profile (i.e., a liner). The stator tube may be cylindrical inside (having a rubber or elastomer insert of varying thickness), or may have a similar multi-lobed, helixed interior profile disposed therein so that the molded-in rubber/elastomer is of a substantially uniform thickness (i.e., even wall). Whether solid rubber/elastomer or even wall, power sections are generally uniform throughout their length. That is, they are either all rubber/elastomer or all even wall over the entire length of the multi-lobed, helixed interior profile. The rotor may also be constructed of a metal, such as steel, with a solid or hollow inner construction. The rotor may have a multi-lobed, helically-shaped outer surface, which compliments the inner surface of the stator. The rotor may also have a rubber or elastomer disposed on its outer surface (i.e., a liner). The outer surface of the rotor has one less lobe than the inner surface of the stator such that a moving, fluid-filled chamber is formed between the rotor and the stator as fluid is pumped through the motor.

The rotor rotates and gyrates in response to a fluid (e.g., drilling fluid or mud) pumped downhole through the drill string and stator of the PDM. The rubber or elastomer materials within the motor, as discussed above, provide a seal between the rotor and the stator. Without this seal, the motor may operate inefficiently and/or fail altogether. Nevertheless, as the rotor turns or rotates within the stator, this rubber or elastomer can sustain undesirable lateral and shear forces between the rotor and the stator, which may lead to motor failure. Motor failure during directional drilling can be a significant and undesirable event. One mode of motor failure is rubber chunking in which one or more portions of the rubber or elastomer break off. Thus, there is a desire to reduce or eliminate the excessive lateral and shear forces sustained by the rubber or elastomer so as to improve motor durability and reduce motor failure.

SUMMARY

Described herein are one or more implementations for a rotor and/or stator dampening system. Such one or more implementations may incorporate a liner into the stator and/or rotor with the liner selected of one or more materials to achieve a desired dampening effect.

In one implementation, a progressive cavity motor or pump may include a stator with an internal axial bore therethrough. The stator has a liner along an axial length thereof with an inwardly facing surface defining the internal axial bore therethrough. The inwardly facing surface has axial lobes arranged and designed to form a stator helical profile. The liner has a plurality of axial sections with at least two of the plurality of axial sections being constructed of different materials. The progressive cavity motor or pump also includes a rotor with an outer surface having axial lobes arranged and designed to form a rotor helical profile that is a least partially complimentary or corresponding to the stator helical profile. The rotor is rotationally disposed within the internal axial bore of the stator to form a moving chamber between the rotor and the stator. The progressive cavity motor or pump further includes a compression resistant mechanism disposed within at least one of the axial sections of the liner. In at least one implementation, the compression resistant mechanism is a spring or spring-like device.

The above referenced summary section is provided to introduce a selection of concepts in a simplified form that are further described below in the detailed description section. The summary is not intended to be used to limit the scope of the claimed subject matter. Furthermore, the claimed subject matter is not limited to implementations that solve disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate various implementations described herein and are not meant to limit the scope of various techniques described herein.

DETAILED DESCRIPTION

Figure 1:
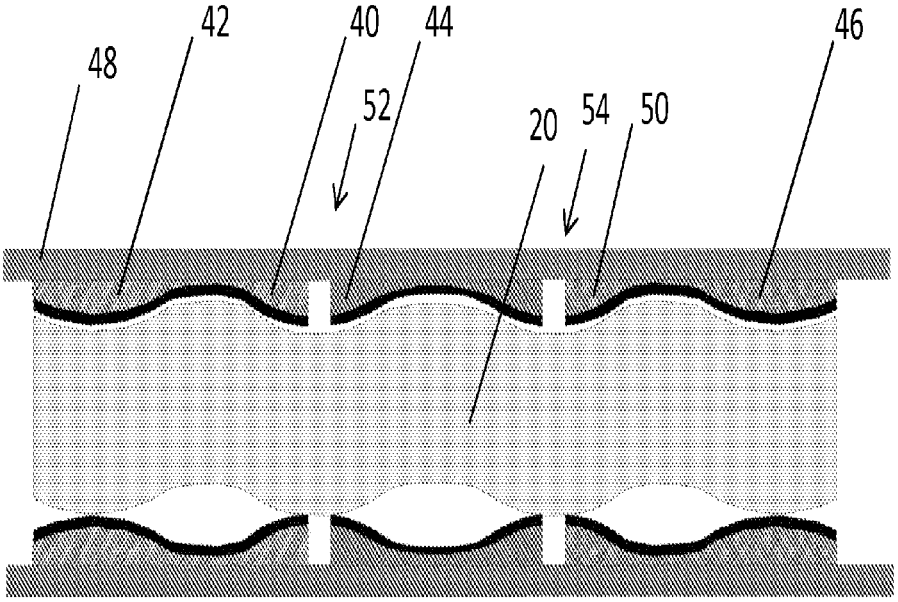
FIG. 1 illustrates a cross-sectional view of a stator and rotor combination in which the stator has a liner in accordance with one or more implementations disclosed herein.

The discussion below is directed to certain specific implementations. It is to be understood that the discussion below is for the purpose of enabling a person with ordinary skill in the art to make and use any subject matter defined now or later by the patent "claims" found in any issued patent herein.

It is specifically intended that the claims not be limited to the implementations and illustrations contained herein, but include modified forms of those implementations including portions of the implementations and combinations of elements of different implementations as come within the scope of the following claims.

Reference will now be made in detail to various implementations, examples of which are illustrated in the accompanying drawings and figures. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, apparatuses and systems have not been described in detail so as not to obscure aspects of the implementations.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the claims. The first object and the second object are both objects, respectively, but they are not to be considered the same object.

The terminology used in the description of the present disclosure herein is for the purpose of describing particular implementations and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses one or more possible combinations of one or more of the associated listed items. It will be further understood that the terms "includes" and/or "including," when used in this specification, specify the presence of stated features, operations, elements, and/or components, but do not preclude the presence or addition of one or more other features, operations, elements, components and/or groups thereof.

As used herein, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells or boreholes that are deviated or horizontal, or when applied to equipment and methods that when arranged in a well or borehole are in a deviated or horizontal orientation, such terms may refer to a left to right, right to left, or other relationships as appropriate.

Various implementations will now be described in more detail with reference to FIGS. 1 and 2. In one or more implementations, a Moineau-type motor or pump (also referred to a progressive cavity or positive displacement motor or pump) has a stator and/or a rotor that includes various sections of liners in which at least one of the liner sections has a higher compressibility than the other sections to permit greater movement (e.g., radial movement) of the rotor. In one or more other implementations, the liner may have an explicit dampening mechanism to alter the normal movement of the rotor.

There are several functions that the stator performs in order for the motor or pump to generate mechanical power or pump fluid. For instance, the stator creates a path for the fluid (i.e., a fluid transport). The stator also creates and seals discrete cavities with the rotor with the sealing function accomplished via the compression of a rubber or elastomer layer therebetween. The stator is also subjected to radial loads due to the centrifugal force of the rotor, and in this way, acts as a radial bearing. The stator gears with the rotor (and withstands the reactive forces from such gearing) so that the stator rotates when fluid is forced into the discrete cavities between the rotor and the stator. Finally, the stator allows the rotor to have a minimum freedom of movement to avoid excessive bending and twisting, which causes additional lateral forces and shear forces on the stator.

In one or more implementations disclosed herein, the freedom of movement of the rotor relative to the stator is manipulated to avoid excessive bending and twisting of the rotor (and/or stator). FIG. 1 illustrates a cross-sectional view of a rotor 20 rotatably disposed within a stator 40 having a liner 50 with a combination of different liner sections 42, 44, 46. The liner sections 42, 44, 46 are constructed of different materials, which are characterized by various degrees of compressibility. In this way, liner sections 42, 44, 46 may be selected and disposed along the axial length of the stator 40/rotor 20 to optimize the stator 40/rotor 20 for sealing (i.e., power generation, fluid transport and the like) and/or for handling mechanical loads (i.e., providing additional freedom for the rotor 20 to move radially without damaging the stator 40).

The stator 40 may have a rigid stator former 48, e.g., a metal form with an inner surface having a helical profile, to which a uniform or near uniform thickness of a liner 42, 44, 46, such as a elastomer material, is molded. The liner improves the sealing between the stator 40 and the rotor 20 while also stiffening the stator 40 for transmission of increased torsional forces. Various types of stator formers 48 are known to those of ordinary skill in the art and are further described in U.S. Reissue Pat. No. 21,374, U.S. Pat. Nos. 3,975,120, 5,171,138 and 5,221,197, among others. In one or more implementations, another section 42, 44, 46 of the stator 40, i.e., another axial section or sections, may have a lower stiffness/compressible liner 50, which allows greater freedom of movement to the rotor 20 or/and dampening effect. In other words, this other section 42, 44, 46 of the stator 40 may reduce some of the lateral contact forces exerted by the rotor 20. This in turn reduces the bending of the rotor 20, which may reduce the shear stress on the elastomer of this other section 42, 44, 46 of liner 50. Thus, having one or more sections 42, 44, 46 of liner 50 with a construction (e.g., elastomer) of greater compressibility may prolong the life of the stator 40 (i.e., the elastomeric lining 50 thereof) while at the same time as giving more or less the same torsional force.

As illustrated in FIG. 1, section 46 of liner 50 disposed on the rightmost portion of the stator 40 (i.e., the downhole end portion) has a high compressibility much like a very soft rubber or any other sponge-like material. This liner section 46 may provide sufficient freedom of movement to the rotor 20 so as to limit the lateral and shear forces on the stator 40 and reduce the bending of the rotor 20.

Section 44 of liner 50 disposed toward the center of the stator 40 may have a lower compressibility than the section 46 right (or downhole) thereof but a higher compressibility than the section 42 left (or uphole) thereof. This center section 44 may have a shared role between providing freedom of movement to the rotor 20 while also providing sealing properties, power generation and fluid transport. Further, in one or more implementations, this center section 44 may have the same construction, i.e., compressibility, as the liner 50 of the sections 42, 46 uphole or downhole thereof, respectively. Conversely, this center section 44 may have a completely different construction (i.e., compressibility) than the other sections 42, 46.

Section 42 of liner 50 disposed on the leftmost portion of the stator 40 (i.e., the uphole end portion) may have the lowest compressibility (i.e., greatest stiffness) and therefore may mainly have the function of proper sealing and delivery of maximum power generation.

With respect to materials of construction, sections 42, 44, 46 may be similar or different depending on the desired compressibility for each section. Section 42, which has been heretofore described as providing proper sealing and delivering power generation, may include a solid rubber of varying thickness, an "even wall" stator, a composite material, a metal plus rubber, a ceramic plus rubber or an epoxy plus rubber or a combination of any of these. Section 46, which has been heretofore described as providing freedom of movement to the rotor, may include a solid rubber of varying thickness (e.g., a soft rubber), colloidal soft materials, a gel or liquid confined in a deformable solid material, a soft colloid-polymer mixture and in general any material or combination of materials with the highest compressibility out of the sections 42, 44, 46 that form the stator 40. Finally, section 44, which has heretofore been described as having a combined function of generating power and also providing a minimum freedom of movement to the rotor 20, may have any type of material described with respect to the other sections 42, 46.

While compressibility is described with respect to FIG. 1 as increasing along the stator/liner in an uphole direction, the relative positioning of the liner sections (and the compressibility of each) are interchangeable. For example, the liner section with the least compressible material of construction may be disposed toward the middle of the stator or near its outlet (i.e., toward the downhole end portion) and vice versa for the others. Also, the number of these liner sections may vary as desired from two to three (as shown) or to any maximum number.

Moreover, while the lengths of the liner sections 42, 44, 46 are shown as being equal or nearly equal, no particular length ratio is dictated between the different sections. Depending on the desired application, it may be more desirable to have greater power generation than a longer life of the power section itself. In such example, the section 42 toward the uphole end portion of the stator should be longer or have a longer length than the other sections 44, 46. Conversely, it may be more desirable to have a longer stator life than a greater power generation. In such example, the section 46 should be the longer section to reduce to a minimum the fatigue failures on the stator 40.

As further illustrated in FIG. 1, the liner 50 may have one or more gaps 52, 54 between the sections 42, 44, 46 thereof. The one or more gaps 52, 54 between liners may permit additional freedom of movement for rotor 20. In one or more implementations, the axial length of the gaps 52, 54 may be tailored to either increase or decrease the movement of rotor 20 as desired. While two distinct gaps 52, 54 are illustrated in FIG. 1, it is readily apparent that one gap (not shown) or several gaps (e.g., of varying axial spacing) maybe disposed between sections of the liner 50. Additionally, one or more gaps may be disposed within a single section having the same materials of construction (i.e., a homogenous compressibility).

Figure 2:
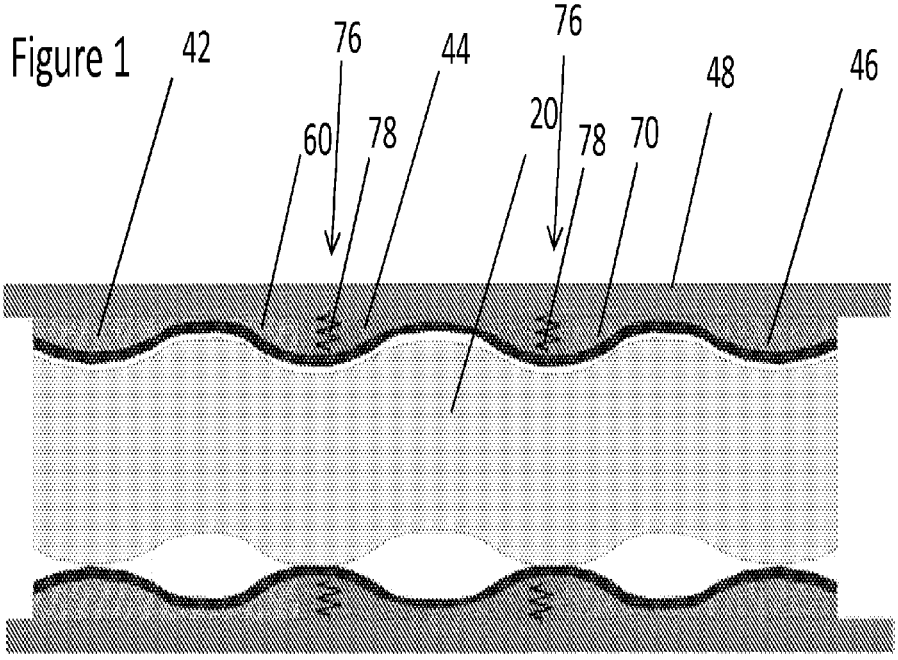
FIG. 2 illustrates a cross-sectional view of a stator and rotor combination in which the stator has a liner in accordance with one or more implementations disclosed herein.

FIG. 2 illustrates a cross-sectional view of a rotor 20 rotatably disposed within a stator 60 having a liner 70 with an explicit dampening system 76 disposed therein. The stator 60 and liner 70 of FIG. 2 are similar to the stator 40 and liner 50 of FIG. 1 in most regards with the exception that the stator 60 and liner 70 of FIG. 2 does not have any gaps. While no gaps are shown in FIG. 2, stator 60 may be so constructed with such gaps as well as an explicit dampening system 76.

Section 44 of liner 70, as shown in FIG. 2, is disposed toward the center of the stator 60 and has an explicit dampening system 76 positioned therein. The role of this dampening system 76 is to gradually limit the movement of the rotor 20 and reduce its bending as well as to reduce the lateral and shear forces on the stator 60. This may be achieved by initially allowing the rotor 20 to push against the liner section 44 of stator 60 but limiting the amount of displacement inside the stator 60.

The explicit dampening system 76 includes a compression resistant mechanism 78, such as a spring or a spring-like device. In one or more implementations, the compression resistant mechanism may be a different material of construction, e.g., an elastomer, within the section of liner that provides additional compression resistance.

The implementation of FIG. 2 may have sections 42 and 46 with similar materials of construction as those described above with respect to sections 42 and 46 of FIG. 1. In addition to the explicit dampening system 76, section 44 of FIG. 2 may be constructed of a solid rubber of varying thickness that will naturally damper. In one or more other implementations, section 44 may be construction of one or more of, without limitation, colloidal soft materials, a gel or liquid confined in a deformable solid material, a soft-colloid-polymer mixture or a combination of metal and elastomer mounted in a spring-like liner. Such materials may act to increase the compressibility or otherwise control compressibility in concert with the compression resistant mechanism 78.

One aspect of the implementations disclosed in FIGS. 1 and 2 is that the stator 40, 60 and its liner 50, 70 are arranged and designed to absorb rotor movement rather than simply constraining it. This permits the rotor 20 to have additional freedom of movement. Further, this additional freedom of movement may result in less contact forces between the rotor 20 and the stator 40, 60 and its liner 50, 70, less bending of the rotor 20 and thus mitigation of any damage to the stator 40, 60 and its liner 50, 70.

While the various liner sections 42, 44, 46 have been described with respect to the stator 40, 60, those of ordinary skill in the art will readily recognize that similar liner sections or construction materials may be molded to or be formed in an outer surface of the rotor 20 to impart similar advantages to the rotor 20 itself. Thus, the same or similar types of combination are also possible on the rotor 20 with the different sections having different functions, as previously described.

Although only a few example implementations have been described in detail above, those skilled in the art will readily appreciate that many modifications are possible in the example implementations without materially departing from "Liners for Rotors and Stators." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of the any of the claims herein, except for those in which the claim expressly uses the words 'means for' together with an associated function.

What is claimed is:

1. A progressive cavity motor or pump comprising:

a stator with an internal axial bore therethrough, the stator having a liner along an axial length thereof with an inwardly facing surface defining the internal axial bore therethrough, the inwardly facing surface with axial lobes forming a stator helical profile, the liner having a plurality of axial sections including a first axial section, a second axial section, and a third axial section, wherein a first compressibility of the first axial section is greater than a second compressibility of the second axial section, and the second compressibility is greater than a third compressibility of the third axial section, wherein at least two of the plurality of axial sections being constructed of different materials, and wherein the second axial section is arranged between the first axial section and the third axial section;

a rotor with an outer surface having axial lobes forming a rotor helical profile that is a least partially complimentary to the stator helical profile, the rotor being rotationally disposed within the internal axial bore of the stator to form a moving chamber between the rotor and the stator.

2. The progressive cavity motor or pump of claim 1, comprising a spring disposed within the second axial section.

3. The progressive cavity motor or pump of claim 2 wherein, an axial gap exists between at least two of the plurality of axial sections.

4. The progressive cavity motor or pump of claim 1 wherein, an axial gap exists between at least two of the plurality of axial sections.

5. The progressive cavity motor or pump of claim 1, the plurality of axial sections being located along the axial length of the stator, wherein the first axial section is nearer an outlet of the stator.

6. The progressive cavity motor or pump of claim 1, comprising a compression resistant mechanism, the compression resistant mechanism being an explicit dampening system separate from and internal to the at least one of the axial sections of the liner.

7. The progressive cavity motor or pump of claim 1, the first axial section comprises a downhole axial section nearer an outlet of the stator and the third axial section comprises an uphole axial section, wherein the downhole axial section is longer than the uphole axial section.

8. The progressive cavity motor or pump of claim 1, the first axial section of the plurality of axial sections including at least one of a colloidal material, a colloid-polymer mixture, a gel confined in a deformable material, and a liquid confined in the deformable material.

9. The progressive cavity motor or pump of claim 1, the first axial section, the second axial section, and the third axial section being constructed of different materials.

10. The progressive cavity motor or pump of claim 1, the rotor having a freedom of movement that is greater in the first axial section of the plurality of axial sections than the second axial section of the plurality of axial sections.

11. The progressive cavity motor or pump of claim 1, wherein the third axial section comprises a sealing section and the first axial section comprises a mechanical load section, the sealing section comprises a composite material, a metal and rubber combination, a ceramic and rubber combination, an epoxy and rubber combination, or any combination thereof.

12. The progressive cavity motor or pump of claim 1, the first axial section comprises a downhole axial section nearer an outlet of the stator and the third axial section comprises an uphole axial section, wherein the uphole axial section is longer than the downhole axial section.

13. A method for manufacturing a positive displacement motor, the method comprising:

providing a stator with an internal axial bore therethrough, the stator having a liner along an axial length thereof with an inwardly facing surface defining the internal axial bore therethrough, the inwardly facing surface with axial lobes forming a stator helical profile, the liner having a plurality of axial sections including a first axial section, a second axial section, and a third axial section, at least two of the plurality of axial sections being constructed of different materials, wherein a first compressibility of the first axial section is greater than a second compressibility of the second axial section, and the second compressibility is greater than a third compressibility of the third axial section;

providing a rotor with an outer surface having axial lobes forming a rotor helical profile that is a least partially complimentary to the stator helical profile, the rotor being rotationally disposed within the internal axial bore of the stator to form a moving chamber between the rotor and the stator; and disposing a first compression resistant mechanism within the second axial section of the plurality of axial sections, wherein the second axial section is arranged between the first axial section and the third axial section, and the first compression resistant mechanism comprises a spring or a material having greater compression resistance than the second axial section.

14. The method of claim 13, the first compression resistant mechanism including the spring.

15. The method of claim 13, further comprising placing an axial gap between at least two of the plurality of axial sections.

16. The method of claim 13 further comprising placing a plurality of axial gaps between at least two sets of two of the plurality of axial sections.

17. The method of claim 13, wherein each of the first axial section and the second axial section comprise at least one of a colloidal material, a colloid-polymer mixture, a gel confined in a deformable material, and a liquid confined in the deformable material.

18. A progressive cavity motor or pump, comprising:

a stator having a liner along an axial length thereof the liner including an inwardly facing surface having stator axial lobes, the inward facing surface of the liner defining an internal axial bore therethrough, the inwardly facing surface and the stator axial lobes, in combination, forming a stator helical profile, the liner having a plurality of axial sections including a first axial section, a second axial section, and a third axial section, at least two of the plurality of axials sections being constructed of different materials, the liner including at least one axial gap, wherein the second axial section is disposed axially between the first axial section and the third axial section, a first compressibility of the first axial section is greater than a second compressibility of the second axial section, and the second compressibility is greater than a third compressibility of the third axial section:

a rotor rotationally disposed within the internal axial bore of the stator to form a moving chamber between the rotor and the stator, the rotor including an outer surface having rotor axial lobes, the outer surface and the rotor axial lobes, in combination, forming a rotor helical profile, the rotor helical profile being positioned in the internal axial bore so as to be at least partially complementary to the stator helical profile, at least a portion of the axial gap of the liner being in direct communication with at least one of the outer surface of the rotationally disposed rotor or the internal axial bore; and a first compression resistant mechanism disposed within at least one of the plurality of axial sections of the liner, the first compression resistant mechanism having greater compression resistance than the respective axial section in which it is disposed.

19. The progressive cavity motor or pump of claim 18, the first compression resistant mechanism including a spring disposed within the second axial section.

20. The progressive cavity motor or pump of claim 18, at least two of the plurality of axial sections including an axial gap.

* * * * *